US010689988B2

(12) United States Patent
Gautschi et al.

(10) Patent No.: US 10,689,988 B2
(45) Date of Patent: Jun. 23, 2020

(54) DISK LUG IMPINGEMENT FOR GAS TURBINE ENGINE AIRFOIL

(71) Applicant: UNITED TECHNOLOGIES CORPORATION, Hartford, CT (US)

(72) Inventors: Steven Bruce Gautschi, Naugatuck, CT (US); San Quach, East Hartford, CT (US); Tracy A Propheter-Hinckley, Manchester, CT (US)

(73) Assignee: Raytheon Technologies Corporation, Farmington, CT (US)

( * ) Notice: Subject to any disclaimer, the term of this patent is extended or adjusted under 35 U.S.C. 154(b) by 477 days.

(21) Appl. No.: 14/683,408

(22) Filed: Apr. 10, 2015

(65) Prior Publication Data

US 2016/0040534 A1 Feb. 11, 2016

Related U.S. Application Data

(60) Provisional application No. 62/011,180, filed on Jun. 12, 2014.

(51) Int. Cl.

*F01D 5/18* (2006.01)
*F01D 5/08* (2006.01)
*F01D 5/30* (2006.01)

(52) U.S. Cl.

CPC ..... *F01D 5/3007* (2013.01); *F01D 5/082* (2013.01); *F05D 2240/81* (2013.01); *F05D 2260/201* (2013.01)

(58) Field of Classification Search

CPC ..... F01D 5/3007; F01D 5/082; F01D 5/186; F01D 5/187; F05D 2240/81; F05D 2260/201

USPC ..... 416/1

See application file for complete search history.

(56) References Cited

U.S. PATENT DOCUMENTS 4,701,105 A 10/1987 Cantor et al.
5,122,033 A * 6/1992 Paul ..... F01D 5/18 416/96 R
6,017,189 A * 1/2000 Judet ..... F01D 5/081 416/97 R
6,171,058 B1 1/2001 Stec
6,308,436 B1 * 10/2001 Stipp ..... D21F 5/006 34/422
6,341,939 B1 * 1/2002 Lee ..... F01D 5/18 415/115
6,416,284 B1 * 7/2002 Demers ..... F01D 5/186 415/115
7,121,797 B2 * 10/2006 Negulescu ..... F01D 5/081 416/97 R
7,186,082 B2 3/2007 Mongillo, Jr. et al.
7,377,748 B2 5/2008 Mongillo, Jr. et al.
7,452,186 B2 11/2008 Charbonneau et al.
7,467,924 B2 12/2008 Charbonneau et al.
7,478,994 B2 1/2009 Cunha et al.
7,597,536 B1 * 10/2009 Liang ..... F01D 5/147 415/115
7,625,172 B2 12/2009 Walz et al.

(Continued)

*Primary Examiner* — Woody A Lee, Jr.
*Assistant Examiner* — Brian Christopher Delrue
(74) *Attorney, Agent, or Firm* — Bachman & LaPointe, P.C.

(57) ABSTRACT

A component for a gas turbine engine includes a root with a neck that extends into a fir tree with at least one tooth, the root includes a feed passage in communication with a multiple of cooling passages that extend through the neck and fir tree.

12 Claims, 8 Drawing Sheets

(56) References Cited

U.S. PATENT DOCUMENTS

| | | | | |
|---|---|---|---|---|
| 8,096,772 | B2 | 1/2012 | Liang | |
| 8,251,651 | B2 | 8/2012 | Propheter-Hinckley et al. | |
| 8,511,980 | B2 | 8/2013 | Propheter-Hinckley et al. | |
| 8,696,304 | B2 * | 4/2014 | Elliott | F01D 5/081 415/115 |
| 2004/0191067 | A1 * | 9/2004 | Phipps | F01D 5/082 416/219 R |
| 2005/0111980 | A1 * | 5/2005 | Negulescu | F01D 5/081 416/97 R |
| 2007/0028960 | A1 * | 2/2007 | Royne | H01L 23/4336 136/259 |
| 2008/0095635 | A1 | 4/2008 | Chon | |
| 2008/0099178 | A1 | 5/2008 | Propheter-Hinckley et al. | |
| 2008/0170944 | A1 | 7/2008 | Propheter-Hinckley | |
| 2008/0199317 | A1 | 8/2008 | Spangler et al. | |
| 2009/0047136 | A1 | 2/2009 | Chon et al. | |
| 2009/0074575 | A1 | 3/2009 | Propheter-Hinckley et al. | |
| 2010/0281868 | A1 * | 11/2010 | Dede | F23R 3/10 60/722 |
| 2014/0020393 | A1 * | 1/2014 | Nakamata | F23R 3/002 60/754 |
| 2015/0118045 | A1 * | 4/2015 | Giametta | F01D 5/18 416/1 |
| 2016/0017718 | A1 * | 1/2016 | Zhang | F01D 5/187 29/889.21 |
| 2016/0040534 | A1 * | 2/2016 | Gautschi | F01D 5/3007 416/1 |
| 2016/0146016 | A1 * | 5/2016 | Johns | F01D 5/3007 416/1 |
| 2016/0169027 | A1 * | 6/2016 | Jones | F01D 11/24 415/116 |

* cited by examiner

DISK LUG IMPINGEMENT FOR GAS TURBINE ENGINE AIRFOIL

CROSS REFERENCE TO RELATED APPLICATION

This application claims the benefit of provisional application Ser. No. 62/011,180, filed Jun. 12, 2014.

STATEMENT REGARDING FEDERALLY SPONSORED RESEARCH OR DEVELOPMENT

This disclosure was made with Government support under N00019-12-D-0002-4Y01 awarded by The United States Navy. The Government has certain rights in this disclosure.

BACKGROUND

The present disclosure relates to components for a gas turbine engine, and more particularly, to cooling features for an airfoil therefor.

Gas turbine engines typically include a compressor section to pressurize airflow, a combustor section to burn a hydrocarbon fuel in the presence of the pressurized air, and a turbine section to extract energy from the resultant combustion gases. Gas path components, such as turbine blades, often include airfoil cooling that may be accomplished by external film cooling, internal air impingement, and forced convection, either separately, or in combination. In forced convection cooling, compressor bleed air flows into the turbine section blades and vanes to continuously remove thermal energy.

Although airfoil cooling has proven effective for cooling of hot section airfoil components, increased temperate engine operations may also effect hardware adjacent to the airfoils such as the rotor disk.

SUMMARY

A component for a gas turbine engine according to one disclosed non-limiting embodiment of the present disclosure includes a root including a neck and a fir tree, said fir tree including at least one tooth, said root includes a feed passage in communication with a tooth cooling passage that extends through said at least one tooth.

A further embodiment of the present disclosure includes, wherein said tooth cooling passage extends through said at least one tooth outside of a maximum compressive stress zone.

A further embodiment of any of the foregoing embodiments of the present disclosure includes, wherein said at least one tooth is an outer tooth of a turbine blade.

A further embodiment of any of the foregoing embodiments of the present disclosure includes, wherein said tooth cooling passage is directed into a circumferential space formed between said outer tooth and a disk fillet that blends an inner lug and an outer lug of a rotor disk when said turbine blade is assembled to said rotor disk.

A further embodiment of any of the foregoing embodiments of the present disclosure includes, wherein said tooth cooling passage defines a hydraulic diameter (d), and a distance (Z) is defined from an exit of said tooth cooling passage to said disk fillet, a ratio Z/d of said distance (Z) to said hydraulic diameter (d) is between about $2.5<Z/d<3.5$.

A further embodiment of any of the foregoing embodiments of the present disclosure includes a neck cooling passage through said neck, said neck cooling passage in communication with said feed passage.

A further embodiment of any of the foregoing embodiments of the present disclosure includes, wherein said neck cooling passage is directed toward said outer lug of said rotor disk.

A further embodiment of any of the foregoing embodiments of the present disclosure includes, wherein a first number of said tooth cooling passages are adjacent a first airfoil sidewall of said turbine blade, and a second number of said tooth cooling passages are adjacent a second airfoil sidewall of said turbine blade.

A further embodiment of any of the foregoing embodiments of the present disclosure includes, wherein said first number is different than said second number.

A further embodiment of any of the foregoing embodiments of the present disclosure includes, wherein a first axial distribution of said first number of tooth cooling passages is different than a second axial distribution of said second number of tooth cooling passages.

A further embodiment of any of the foregoing embodiments of the present disclosure includes, wherein said first axial distribution includes an axially fore and aft bias, and said second axial distribution includes a bias toward the axial midsections.

A component for a gas turbine engine according to another disclosed non-limiting embodiment of the present disclosure includes a root including a neck and a fir tree, said fir tree including at least one tooth, said root includes a feed passage in communication with a neck cooling passage that extends through said neck.

A further embodiment of any of the foregoing embodiments of the present disclosure includes, wherein said root extends between a platform and said fir tree of a turbine blade, said at least one tooth is an outer tooth of said fir tree.

A further embodiment of any of the foregoing embodiments of the present disclosure includes, wherein said turbine blade is assembled to a rotor disk such that said outer tooth is received adjacent a disk fillet that blends an inner lug and an outer lug of said rotor disk.

A further embodiment of any of the foregoing embodiments of the present disclosure includes, wherein said neck cooling passage is directed toward said outer lug.

A further embodiment of any of the foregoing embodiments of the present disclosure includes, wherein said neck cooling passage defines a hydraulic diameter (d), and a distance (Z) is defined between an exit of said neck cooling passage to said outer lug, a ratio Z/d of said distance (Z) to said hydraulic diameter (d) is between about $2.5<Z/d<3.5$.

A method of cooling a rotor disk for a gas turbine engine according to another disclosed non-limiting embodiment of the present disclosure includes directing cooling air from a feed passage within a rotor blade though a multiple of tooth cooling passage is that extend through an outer tooth of the rotor blade, the cooling air directed into a circumferential space between the outer tooth and a disk fillet that blends an inner lug and an outer lug of a rotor disk and directing cooling air from the feed passage through a multiple of neck cooling passage that extends through a neck of the rotor blade, the cooling air directed from the neck cooling passage toward the outer lug of the rotor disk.

A further embodiment of any of the foregoing embodiments of the present disclosure includes, wherein the multiple of tooth cooling passages are located on a pressure and a suction side of the rotor blade.

A further embodiment of any of the foregoing embodiments of the present disclosure includes, arranging a first axial distribution of the multiple of tooth and neck cooling passages adjacent a first airfoil sidewall of the rotor blade, and a second axial distribution of the multiple of tooth and neck cooling passages adjacent a second airfoil sidewall of the rotor blade such that the first axial distribution is different than the second axial distribution.

A further embodiment of any of the foregoing embodiments of the present disclosure includes, distributing the multiple of tooth and neck cooling passages in a first axial distribution adjacent to a first airfoil sidewall of the rotor blade such that the multiple of tooth and neck cooling passages are biased axially fore and aft adjacent the first airfoil sidewall, and toward an axial mid section adjacent a second airfoil sidewall.

The foregoing features and elements may be combined in various combinations without exclusivity, unless expressly indicated otherwise. These features and elements as well as the operation thereof will become more apparent in light of the following description and the accompanying drawings. It should be understood, however, the following description and drawings are intended to be exemplary in nature and non-limiting.

BRIEF DESCRIPTION OF THE DRAWINGS

Various features will become apparent to those skilled in the art from the following detailed description of the disclosed non-limiting embodiment. The drawings that accompany the detailed description can be briefly described as follows.

DETAILED DESCRIPTION

Figure 1:
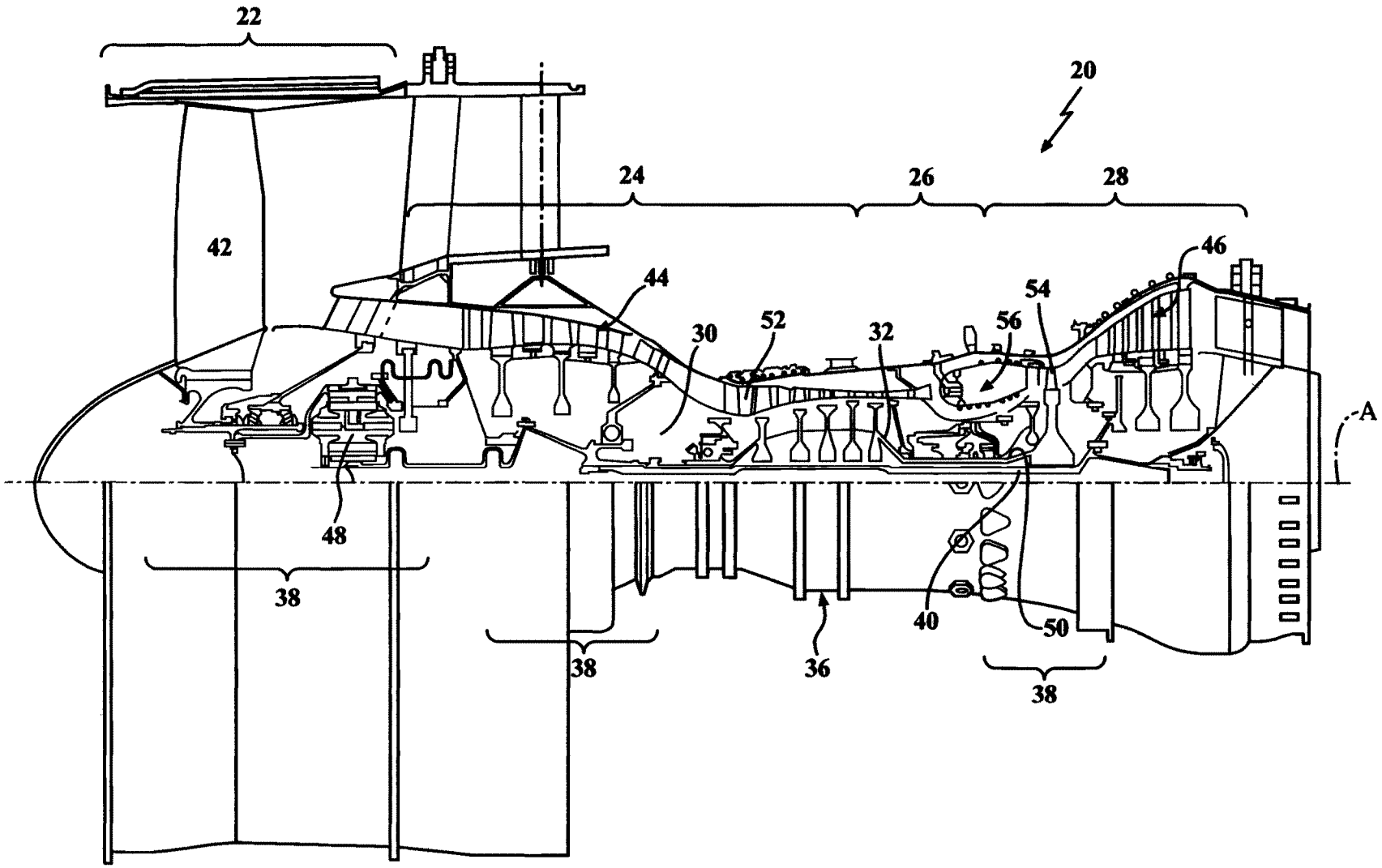
FIG. 1 is a schematic cross-section of an example gas turbine engine architecture.
Figure 2:
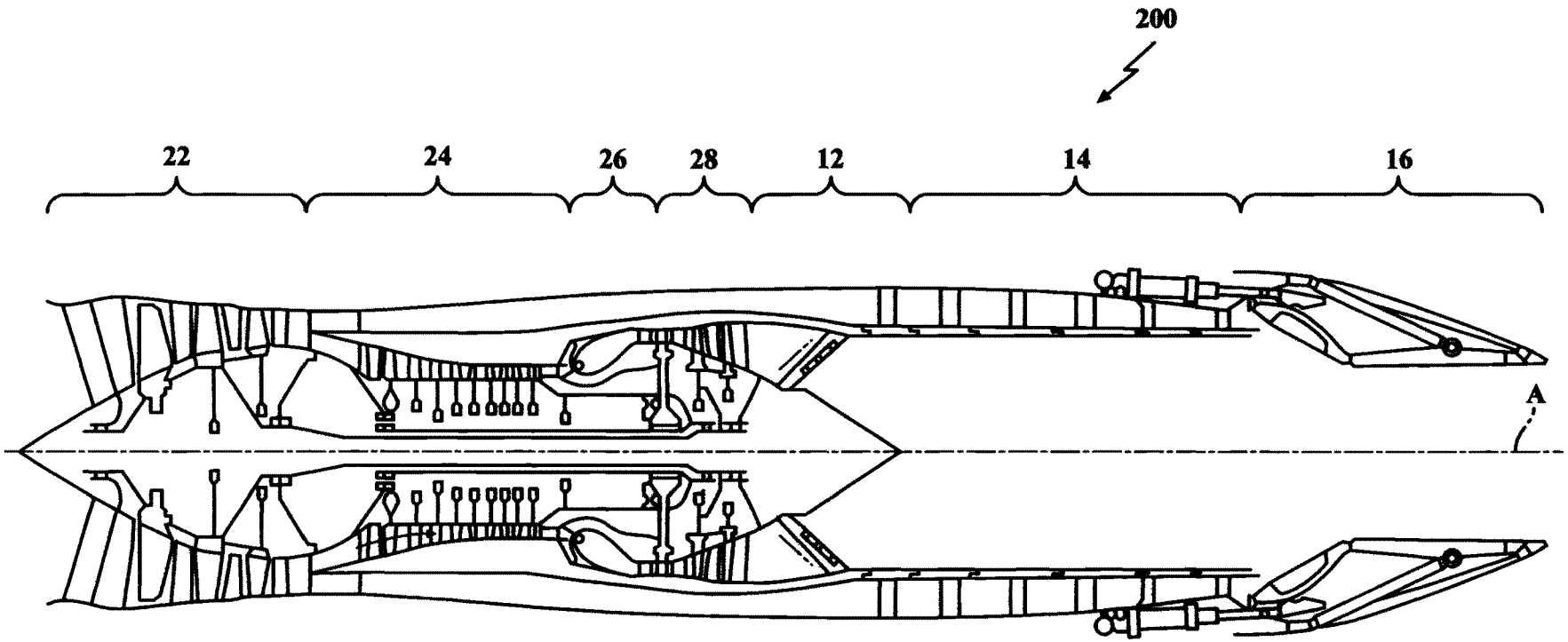
FIG. 2 is a schematic cross-section of another example gas turbine engine architecture.

FIG. 1 schematically illustrates a gas turbine engine 20. The gas turbine engine 20 is disclosed herein as a two-spool turbo fan that generally incorporates a fan section 22, a compressor section 24, a combustor section 26 and a turbine section 28. Alternative engine architectures 200 might include an augmentor section 12, an exhaust duct section 14 and a nozzle section 16 (FIG. 2) among other systems or features. The fan section 22 drives air along a bypass flowpath while the compressor section 24 drives air along a core flowpath for compression and communication into the combustor section 26 then expansion through the turbine section 28. Although depicted as a turbofan in the disclosed non-limiting embodiment, it should be appreciated that the concepts described herein are not limited to use with turbofans as the teachings may be applied to other types of turbine engine architectures such as turbojets, turboshafts, and three-spool (plus fan) turbofans.

The engine 20 generally includes a low spool 30 and a high spool 32 mounted for rotation about an engine central longitudinal axis A relative to an engine case structure 36 via several bearing compartments 38. The low spool 30 generally includes an inner shaft 40 that interconnects a fan 42, a low pressure compressor ("LPC") 44 and a low pressure turbine ("LPT") 46. The inner shaft 40 drives the fan 42 directly or through a geared architecture 48 to drive the fan 42 at a lower speed than the low spool 30. An exemplary reduction transmission is an epicyclic transmission, namely a planetary or star gear system.

The high spool 32 includes an outer shaft 50 that interconnects a high pressure compressor ("HPC") 52 and high pressure turbine ("HPT") 54. A combustor 56 is arranged between the HPC 52 and the HPT 54. The inner shaft 40 and the outer shaft 50 are concentric and rotate about the engine central longitudinal axis A which is collinear with their longitudinal axes.

Core airflow is compressed by the LPC 44 then the HPC 52, mixed with the fuel and burned in the combustor 56, then expanded over the HPT 54 and the LPT 46, which rotationally drive the respective low spool 30 and high spool 32 in response to the expansion. The main engine shafts 40, 50 are supported at a plurality of points by bearing compartments 38 within the engine case structure 36.

Figure 3:
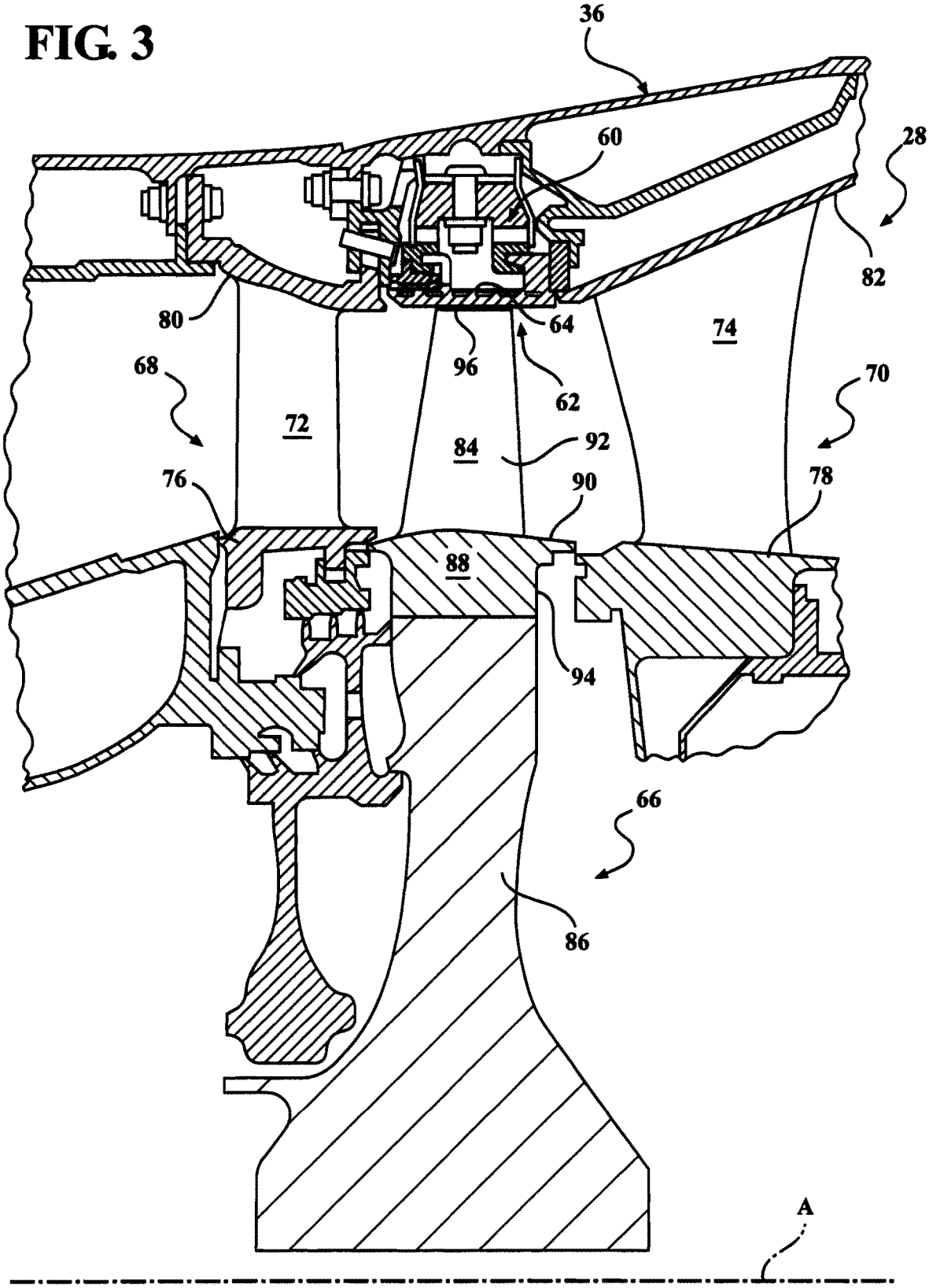
FIG. 3 is an enlarged schematic cross-section of an engine turbine section.

With reference to FIG. 3, an enlarged schematic view of a portion of the HPT 54 is shown by way of example; however, other engine sections will also benefit herefrom. A full ring shroud assembly 60 mounted to the engine case structure 36 supports a Blade Outer Air Seal (BOAS) assembly 62 with a multiple of circumferentially distributed BOAS 64 proximate to a rotor assembly 66 (one schematically shown).

The full ring shroud assembly 60 and the BOAS assembly 62 are axially disposed between a forward stationary vane ring 68 and an aft stationary vane ring 70. Each vane ring 68, 70 includes an array of vanes 72, 74 that extend between a respective inner vane platform 76, 78, and an outer vane platform 80, 82. The outer vane platforms 80, 82 are attached to the engine case structure 36.

Figure 4:
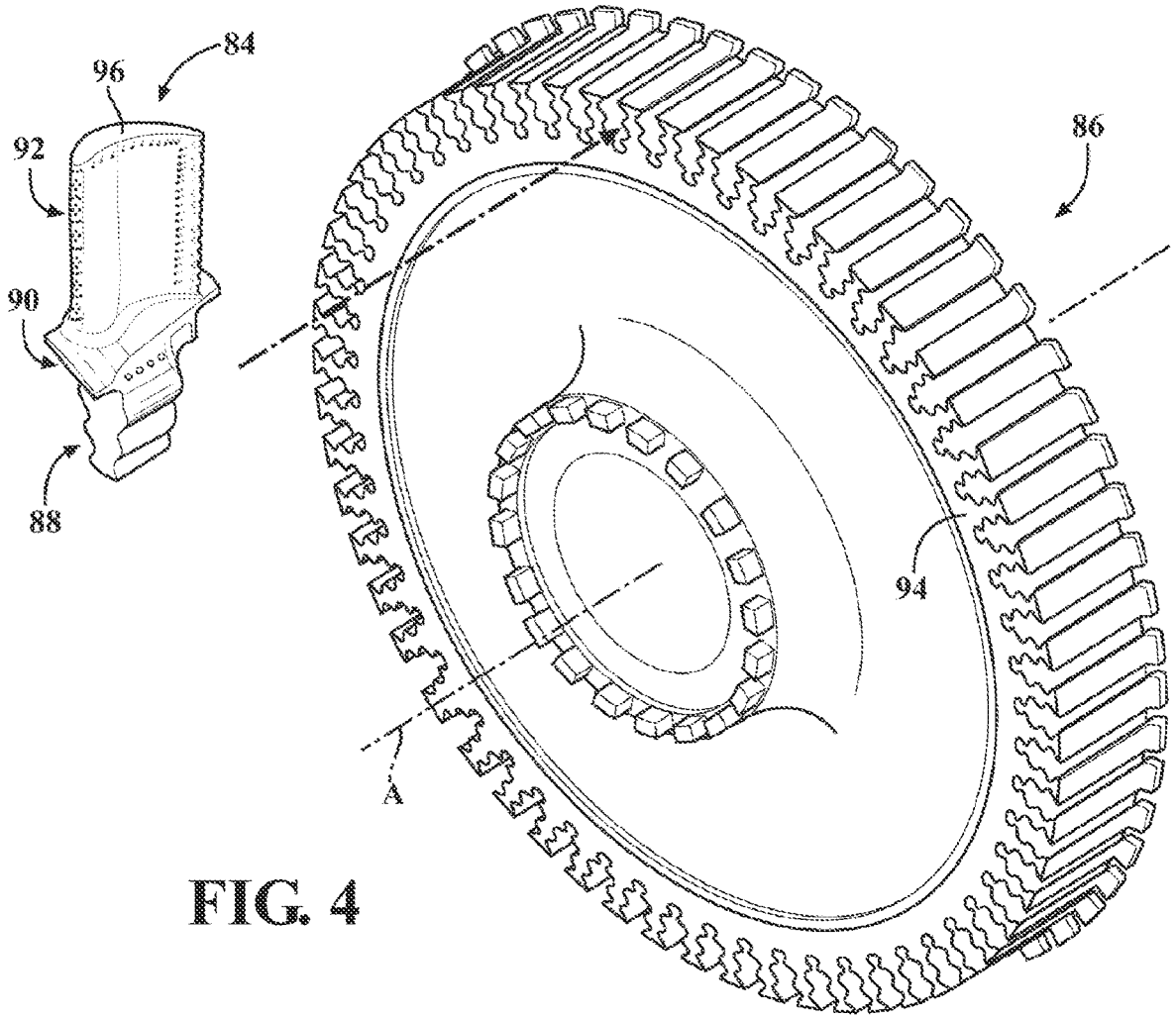
FIG. 4 is an exploded view of rotor assembly with a single representative turbine blade.

The rotor assembly 66 includes an array of blades 84 circumferentially disposed around a disk 86. Each blade 84 includes a root 88, a platform 90 and an airfoil 92 (also shown in FIG. 4). The blade roots 88 are received within a rim 94 of the disk 86 and the airfoils 92 extend radially outward such that a tip 96 of each airfoil 92 is closest to the blade outer air seal (BOAS) assembly 62. The platform 90 separates a gas path side inclusive of the airfoil 92 and a non-gas path side inclusive of the root 88.

Figure 5:
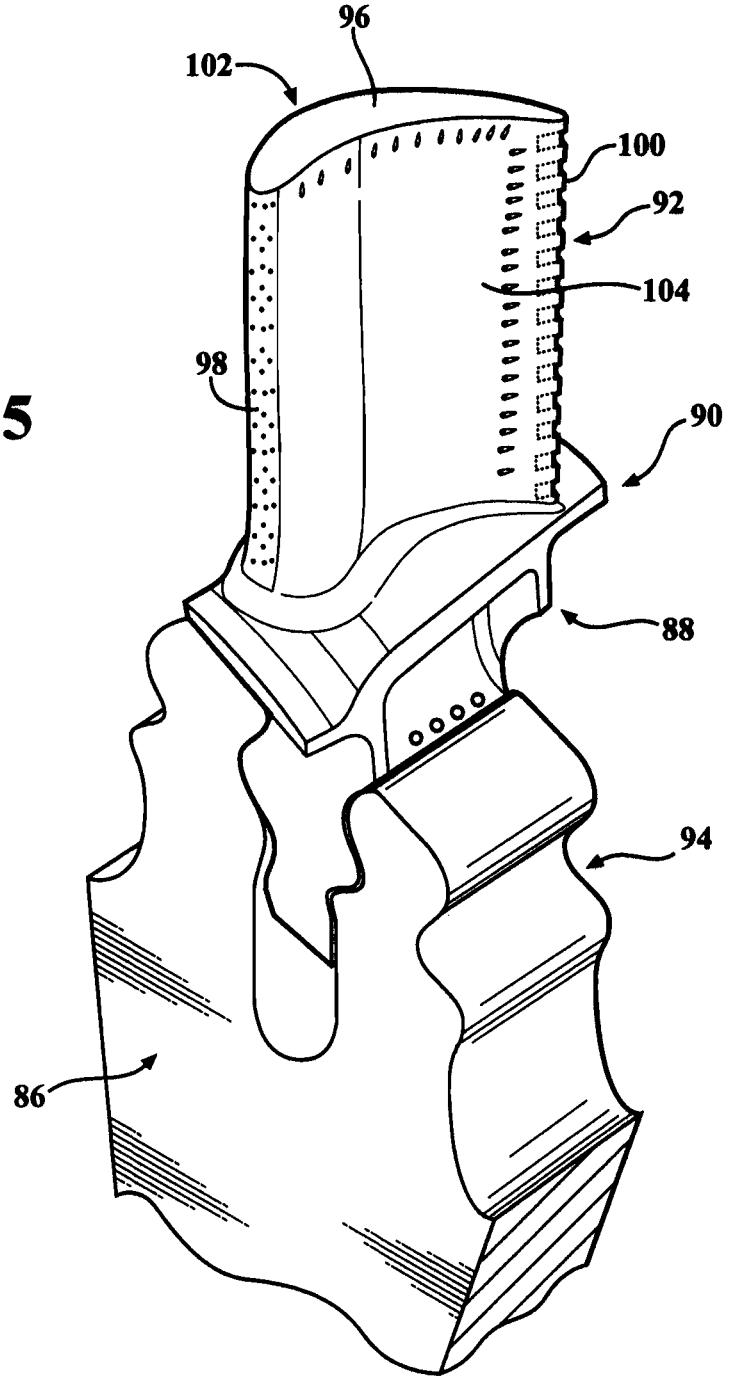
FIG. 5 is a partial sectional view of the rotor assembly of FIG. 4 with the single representative turbine blade in an installed position.

With reference to FIG. 5, the platform 90 generally separates the root 88 and the airfoil 92 to define an inner boundary of the core gas path. The airfoil 92 defines a blade chord between a leading edge 98, which may include various forward and/or aft sweep configurations, and a trailing edge 100. A first airfoil sidewall 102 that may be convex to define a suction side, and a second airfoil sidewall 104 that may be concave to define a pressure side are joined at the leading edge 98 and at the axially spaced trailing edge 100. The tip 96 extends between the sidewalls 102, 104 opposite the platform 90. It should be appreciated that the tip 96 may include a recessed portion.

Figure 6:
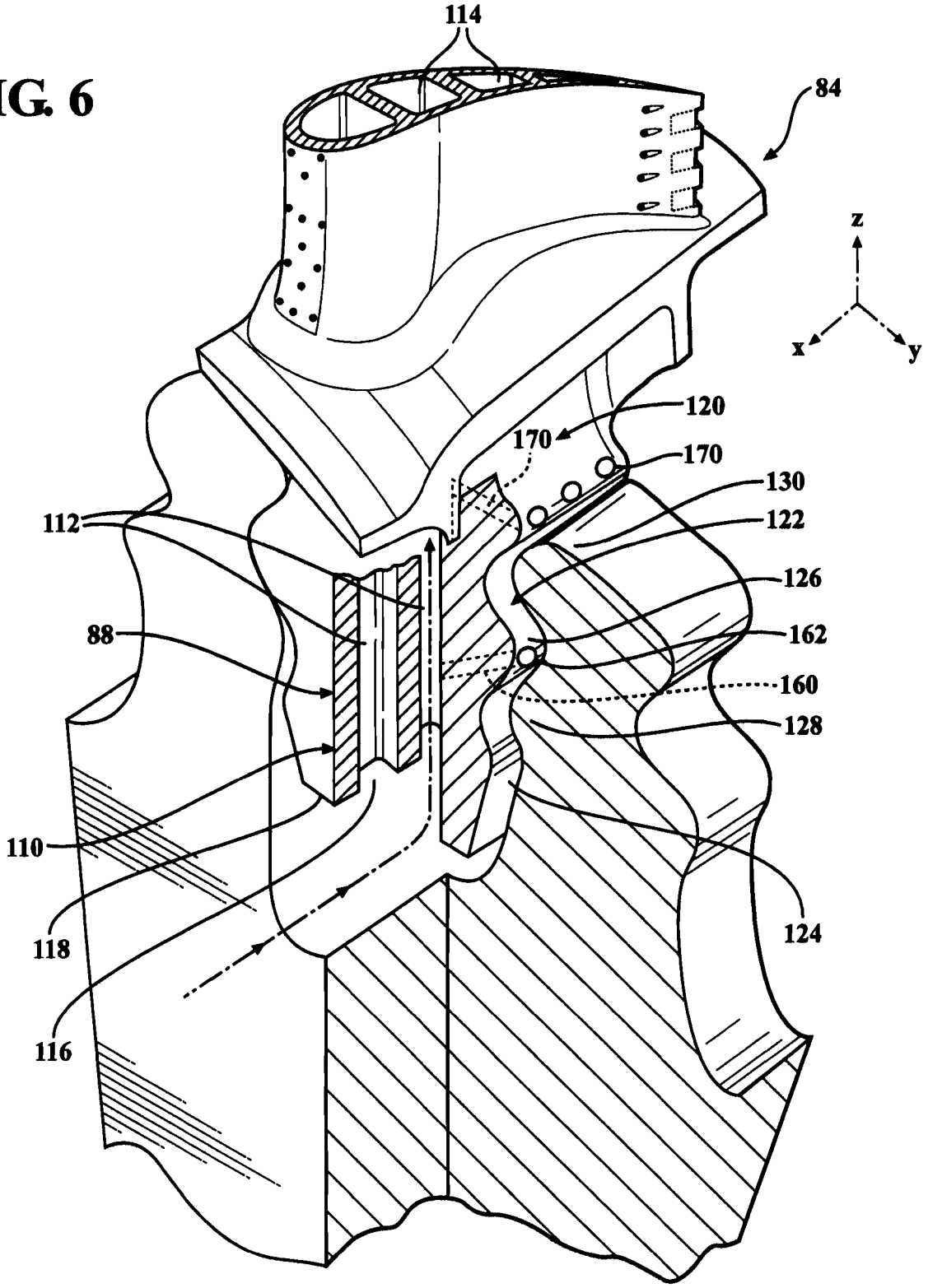
FIG. 6 is a partial sectional view of the of turbine blade according to one disclosed non-limiting embodiment.

With reference to FIG. 6 to resist the high temperature stress environment in the gas path of a turbine engine, each blade 84 includes an array of internal passageways 110, although a turbine blade 84 will be described and illustrated in detail, other hot section components to include, but not limited to, vanes, turbine shrouds, end walls, and other components will also benefit from the teachings herein.

The array of internal passageways 110 includes a multiple of feed passage 112 through the root 88 that communicates airflow into a multiple of cavities 114 (shown schematically) within the airfoil 92. The feed passage 112 generally receives cooling flow through at least one inlet 116 within the base 118 of the root 88 (also shown in FIG. 7). It should be appreciated that various feed architectures, cavities, and passageway arrangements will benefit herefrom.

The root 88 generally includes a neck 120 adjacent to the platform 90. The neck 120 extends into a fir tree 122 that, in this disclosed non-limiting embodiment, includes an inner tooth 124, and an outer tooth 126. The inner tooth 124, and the outer tooth 126 respectively engage with an inner lug 128 and an outer lug 130 that are formed in the rim 94 of the disk 86.

Figure 7:
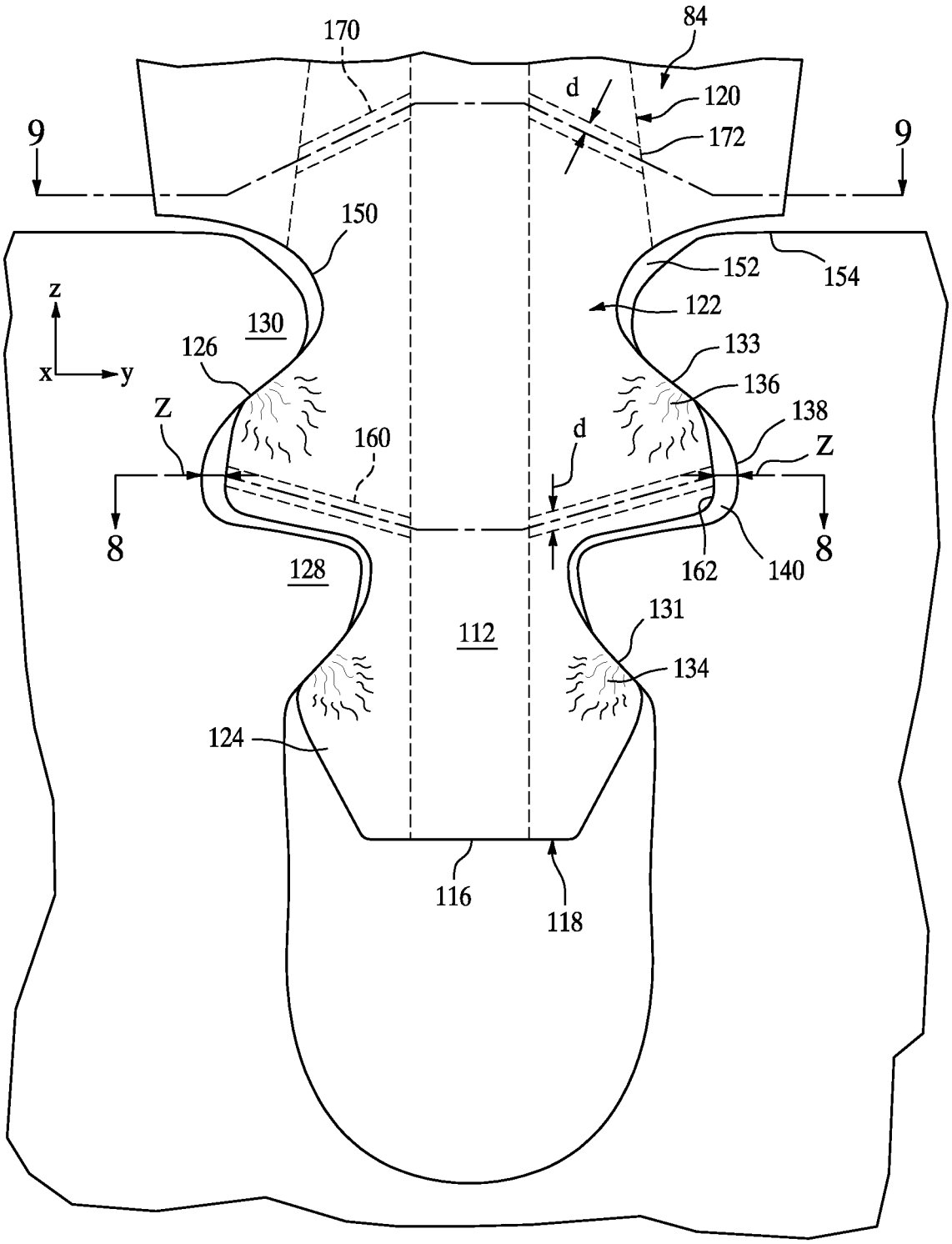
FIG. 7 is a circumferential sectional view of the of turbine blade of FIG. 6.

With respect to FIG. 7, the inner tooth 124 engages with the inner lug 128 at a respective inner interface surface 131 and the outer tooth 126 engage with the outer lug 130 at respective inner interface surface 133. Maximum compressive stress zones 134, 136 (illustrated schematically) are formed adjacent to the interface surfaces 131, 133 from the centrifugal and rotational forces applied to the blade 84.

A disk fillet 138 blends the inner lug 128 and the outer lug 130 to form a circumferential space 140 between the outer tooth 126, and the disk 86. A blade fillet 150 blends the outer tooth 126 and the neck 120 to form a circumferential space 152 between the outer tooth 126 and the disk 86 adjacent to an outer surface 154 of the disk 86.

The outer tooth 126 includes a multiple of tooth cooling passages 160 directed into the circumferential space 140 between the outer tooth 126 and the disk fillet 138 to communicate secondary airflow from the feed passages 112 thereto. In other words, in an X-Y-Z coordinate system with the X-axis parallel to the engine central longitudinal axis A, the multiple of cooling passage 160 may be angled within the Y-Z plane to be non-parallel to the Y-axis. Each of the multiple of tooth cooling passages 160 are also positioned through the outer tooth 126 to avoid the maximum compressive stress zones 136 such that the strength of the fir tree 122 is unaffected. The multiple of tooth cooling passages 160 communicate secondary airflow from the feed passage 112 to reduce the thermal gradient through the outer tooth 126 as well as cool an inner surface of the outer lug 130. Although an individual tooth and lug arrangement is described, it should be appreciated that the cooling passages 160 may be located adjacent to one or more teeth of the fir tree 122.

The neck 120 includes a multiple of neck cooling passages 170 directed toward the outer surface 154 of the disk 86, which is also the outer surface of the outer lug 130. The multiple of neck cooling passages 170 communicate secondary airflow from the feed passage 112 to cool the outer surface 154 of the disk 86 and thus the outer lug 130. In other words, in an X-Y-Z coordinate system with the X-axis parallel to the engine central longitudinal axis A, the multiple of cooling passage 170 may be angled within the Y-Z plane to be non-parallel to the Y-axis and generally opposed to the multiple of cooling passage 160. Such that the passages 160, 170 are directed toward the outer lug 130.

Each of the multiple of cooling passage 160 define a hydraulic diameter (d) and a distance (Z) from a cooling passage exit 162 to the disk fillet 138 opposite the cooling passage exit 162. Each of the multiple of cooling passage 170 likewise defines a hydraulic diameter (d) and a distance (Z) from a cooling passage exit 172 to the outer surface 154 of the disk 86 opposite the cooling passage exit 172. In one disclosed non-limiting embodiment, the distance (Z) to the hydraulic diameter (d) ratio is between about $2.5<Z/d<3.5$ with a preferred distance in this disclosed embodiment of 2.5 for optimal heat transfer. It should be appreciated that the distance Z from the exit 162, 172 need not be equivalent.

Figure 8:
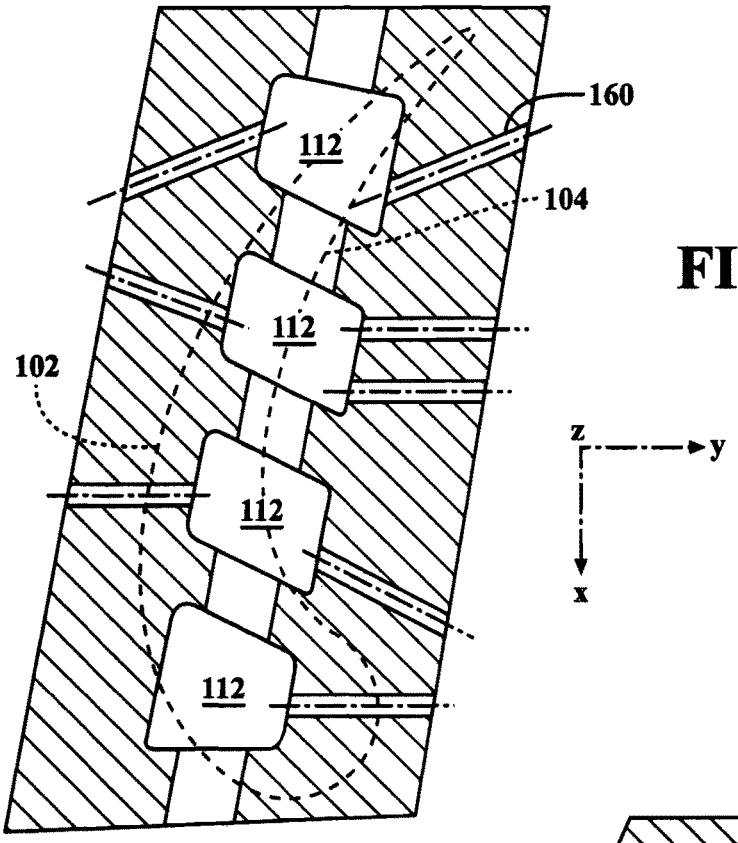
FIG. 8 is an axial sectional view along line 8-8 in FIG. 7.
Figure 9:
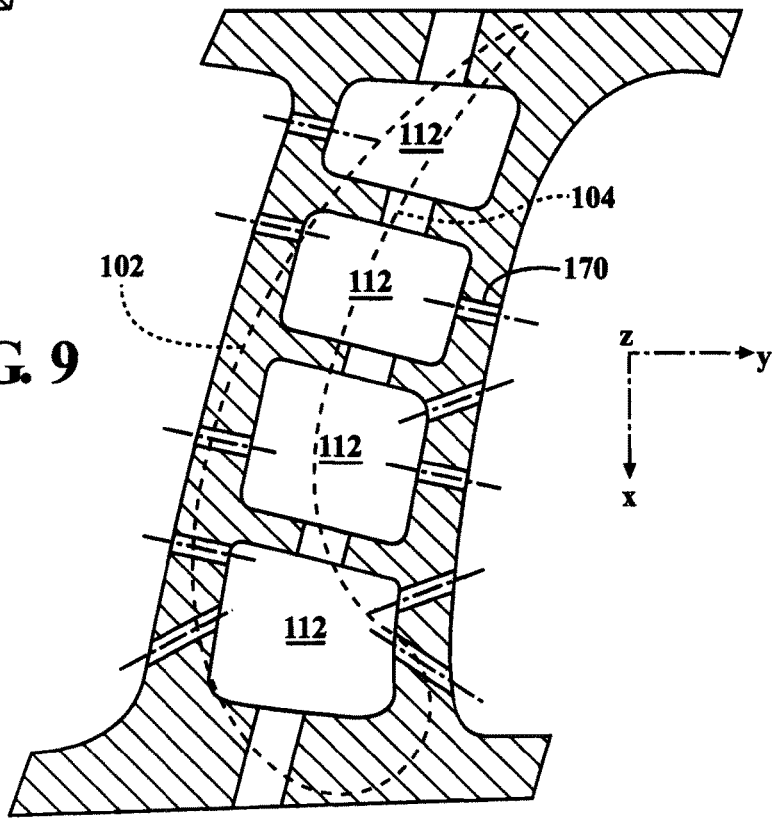
FIG. 9 is an axial sectional view along line 9-9 in FIG. 7.

The multiple of cooling passage 160 (FIG. 8) and the multiple of cooling passage 170 (FIG. 9) may be arranged to define a vector toward the outer surface 154 of the disk 86. That is, the multiple of cooling passage 160, 170 may be angled toward the outer surface 154 of the disk 86 in addition to the angle toward the outer lug 130 and the outer surface 154 of the disk 86 to specifically direct the cooling airflow. In other words, in an X-Y-Z coordinate system, with the X-axis parallel to the engine central longitudinal axis A, the multiple of cooling passage 160, 170 may be angled within the X-Y plane to be non-parallel to the Y-axis (FIGS. 8 and 9). In this disclosed non-limiting embodiment, the multiple of cooling passage 160, 170 are effectively directed along either side the axial span of the outer lug 130 of the disk 86.

With reference to FIGS. 8 and 9, in addition to the angles thereof, the number and/or axial distribution of cooling passages 160, 170 adjacent the first airfoil sidewall 102 may be different than the number and/or axial distribution of the cooling passages 160, 170 adjacent to the second airfoil sidewall 104. In one example, the cooling passages 160, 170 adjacent the first airfoil sidewall 102 are biased axially fore and aft while the cooling passages 160, 170 adjacent to the second airfoil sidewall 104 are axially biased toward the axial mid section. It should be appreciated that various other distributions, numbers, angles, and combinations thereof may alternatively, or additionally, be provided.

The multiple of cooling passage 160, 170 are positioned to deliver cooling airflow toward the outer lug 130 to thereby combat the high temperatures that may otherwise increase the stresses within these highly stressed disk regions. That is, the multiple of cooling passage 160, 170 deliver cooling airflow directly and/or indirectly to desired areas of the rotor disk 86. Furthermore, the multiple of cooling passage 160, 170 are readily incorporated into the blade 84 without modifications to adjacent hardware such as a cover plate.

The use of the terms "a," "an," "the," and similar references in the context of description (especially in the context of the following claims) are to be construed to cover both the singular and the plural, unless otherwise indicated herein or specifically contradicted by context. The modifier "about" used in connection with a quantity is inclusive of the stated value and has the meaning dictated by the context (e.g., it includes the degree of error associated with measurement of the particular quantity). All ranges disclosed herein are inclusive of the endpoints, and the endpoints are independently combinable with each other.

Although the different non-limiting embodiments have specific illustrated components, the embodiments of this invention are not limited to those particular combinations. It is possible to use some of the components or features from any of the non-limiting embodiments in combination with features or components from any of the other non-limiting embodiments.

It should be appreciated that like reference numerals identify corresponding or similar elements throughout the several drawings. It should also be appreciated that although a particular component arrangement is disclosed in the illustrated embodiment, other arrangements will benefit herefrom.

Although particular step sequences are shown, described, and claimed, it should be understood that steps may be performed in any order, separated or combined unless otherwise indicated and will still benefit from the present disclosure.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be understood that within the scope of the appended claims, the disclosure may be practiced other than as specifically described. For that reason the appended claims should be studied to determine true scope and content.

What is claimed:

1. A turbine blade for a gas turbine engine, comprising:

a root including a neck and a fir tree, said fir tree including an outer tooth, said root includes a feed passage in communication with a tooth cooling passage that extends through said outer tooth outside of a maximum compressive stress zone formed when said outer tooth is in contact with a rotor disk, said tooth cooling passage configured to direct air therefrom to directly impinge upon a disk fillet that blends an inner lug and an outer lug of the rotor disk when said turbine blade is assembled to said rotor disk, wherein said tooth cooling passage defines a hydraulic diameter (d), and a distance (Z) is defined from an exit of said tooth cooling passage to said disk fillet, a ratio Z/d of said distance (Z) to said hydraulic diameter (d) is between $2.5<Z/d<3.5$, wherein in an X-Y-Z coordinate system, with the X-axis parallel to the engine central longitudinal axis A, said tooth cooling passages are angled within the X-Y plane to be non-parallel to the Y-axis and upward toward the disk fillet.

2. The turbine blade as recited in claim 1, further comprising a neck cooling passage through said neck, said neck cooling passage in communication with said feed passage.

3. The turbine blade as recited in claim 2, wherein said neck cooling passage is directed toward said outer lug of said rotor disk.

4. The turbine blade as recited in claim 1, wherein a first number of said tooth cooling passages are adjacent a first airfoil sidewall of said turbine blade, and a second number of said tooth cooling passages are adjacent a second airfoil sidewall of said turbine blade.

5. The turbine blade as recited in claim 4, wherein said first number is different than said second number.

6. The turbine blade as recited in claim 4, wherein a first axial distribution of said first number of tooth cooling passages is different than a second axial distribution of said second number of tooth cooling passages.

7. The turbine blade as recited in claim 6, wherein said first axial distribution includes an axially fore and aft bias, and said second axial distribution includes a bias toward the axial midsections.

8. A turbine blade for a gas turbine engine, comprising:

a root including a neck and a fir tree, said fir tree including an outer tooth, said root extends between a platform and said fir tree, said root includes a feed passage in communication with a neck cooling passage that extends through said neck such that when said turbine blade is assembled to a rotor disk, said outer tooth is received adjacent a disk fillet that blends an inner lug and an outer lug of said rotor disk, said neck cooling passage is configured to direct air therefrom to directly impinge upon said outer lug, wherein said neck cooling passage defines a hydraulic diameter (d), and a distance (Z) is defined between an exit of said neck cooling passage to said outer lug, a ratio Z/d of said distance (Z) to said hydraulic diameter (d) is between $2.5<Z/d<3.5$, wherein in an X-Y-Z coordinate system, with the X-axis parallel to the engine central longitudinal axis A, said neck cooling passage are angled within the X-Y plane to be non-parallel to the Y-axis and downward toward the outer lug with respect to an inlet within the base of the root.

9. A method of cooling a rotor disk for a gas turbine engine, comprising:

directing cooling air from a feed passage within a rotor blade through a multiple of tooth cooling passages that extend through an outer tooth of the rotor blade avoiding a maximum compressive stress zone, the cooling air directed into a circumferential space between the outer tooth and a disk fillet that blends an inner lug and an outer lug of a rotor disk to directly impinge upon a disk fillet that blends an inner lug and an outer lug of the rotor disk when said turbine blade is assembled to said rotor disk, wherein said tooth cooling passage defines a hydraulic diameter (d), and a distance (Z) is defined from an exit of said tooth cooling passage to said disk fillet, a ratio Z/d of said distance (Z) to said hydraulic diameter (d) is between $2.5<Z/d<3.5$ wherein in an X-Y-Z coordinate system, with the X-axis parallel to the engine central longitudinal axis A, said tooth cooling passages are angled within the X-Y plane to be non-parallel to the Y-axis and upward toward the disk fillet; and directing cooling air from the feed passage through a multiple of neck cooling passages that extends through a neck of the rotor blade avoiding a maximum compressive stress zone, the cooling air directed from the neck cooling passage to directly impinge upon the outer lug of the rotor disk, wherein said neck cooling passage defines a hydraulic diameter (d), and a distance (Z) is defined between an exit of said neck cooling passage to said outer lug, a ratio Z/d of said distance (Z) to said hydraulic diameter (d) is between $2.5<Z/d<3.5$, wherein in the X-Y-Z coordinate system, with the X-axis parallel to the engine central longitudinal axis A, said neck cooling passage are angled within the X-Y plane to be non-parallel to the Y-axis and downward toward the outer lug.

10. The method as recited in claim 9, wherein the multiple of tooth cooling passages are located on a pressure and a suction side of the rotor blade.

11. The method as recited in claim 9, further comprising arranging a first axial distribution of the multiple of tooth and neck cooling passages adjacent a first airfoil sidewall of the rotor blade, and a second axial distribution of the multiple of tooth and neck cooling passages adjacent a second airfoil sidewall of the rotor blade such that the first axial distribution is different than the second axial distribution.

12. The method as recited in claim 9, further comprising distributing the multiple of tooth and neck cooling passages in a first axial distribution adjacent to a first airfoil sidewall of the rotor blade such that the multiple of tooth and neck cooling passages are biased axially fore and aft adjacent the first airfoil sidewall, and toward an axial mid section adjacent a second airfoil sidewall.

* * * * *